US006231695B1

(12) United States Patent
Heiler et al.

(10) Patent No.: US 6,231,695 B1
(45) Date of Patent: May 15, 2001

(54) METHOD OF HEAT-TREATING A THIN SHEET COATED WITH ZNAL BY HOT DIP GALVANIZATION

(75) Inventors: Hans-Joachim Heiler, Moers; Wilhelm Warnecke, Hamminkeln; Wilhelm Dürr, Dinslaken; Günther Höbelheinrich, Lennestadt, all of (DE)

(73) Assignee: Thyssen Stahl AG, Duisburg (DE)

( * ) Notice: Subject to any disclaimer, the term of this patent is extended or adjusted under 35 U.S.C. 154(b) by 0 days.

(21) Appl. No.: 09/308,104

(22) PCT Filed: Sep. 3, 1997

(86) PCT No.: PCT/EP97/04787

§ 371 Date: Jun. 2, 1999

§ 102(e) Date: Jun. 2, 1999

(87) PCT Pub. No.: WO98/21378

PCT Pub. Date: May 22, 1998

(30) Foreign Application Priority Data

Nov. 9, 1996 (DE) ..... 196 46 362

(51) Int. Cl.[7] ..... C21D 9/46; C23C 2/06; C23C 2/28

(52) U.S. Cl. ..... 148/518; 148/526; 148/533

(58) Field of Search ..... 148/512, 518, 148/526, 533

(56) References Cited

U.S. PATENT DOCUMENTS

| | | | | |
|---|---|---|---|---|
| 4,390,377 | * | 6/1983 | Hogg | 148/518 |
| 5,015,341 | * | 5/1991 | Guzzetta et al. | 148/518 |

FOREIGN PATENT DOCUMENTS

| | | |
|---|---|---|
| 365 658 | 2/1982 | (AT) . |
| 225000 | 5/1962 | (DE) . |
| 29 41 850 A1 | 4/1980 | (DE) . |
| 0 026 757 B1 | 2/1985 | (EP) . |
| 0 710 732 A1 | 10/1995 | (EP) . |
| 59-104462 | 6/1984 | (JP) . |
| 59-145770 | 8/1984 | (JP) . |
| WO 89/09844 | 10/1989 | (WO) . |

* cited by examiner

*Primary Examiner*—George Wyszomierski
(74) *Attorney, Agent, or Firm*—Proskauer Rose LLP

(57) ABSTRACT

A thin sheet is coated by hot dip galvanization with a zinc based alloy comprising 3.5% to 15% by weight of aluminum. Immediately after solidification of the coating, the thin sheet is heated for 2 to 10 seconds to a temperature 20 to 100° C. above the melting point of the coating. The thin sheet is then cooled to room temperature.

4 Claims, 1 Drawing Sheet

500:1

500:1

500:1

METHOD OF HEAT-TREATING A THIN SHEET COATED WITH ZNAL BY HOT DIP GALVANIZATION

BACKGROUND OF THE INVENTION

This invention concerns a method of heat treating a thin sheet coated with a zinc alloy containing aluminum by hot dip galvanization.

Hot dip galvanizing of a thin sheet with zinc and/or aluminum or alloys thereof in a continuous operation is usually performed by passing the strip through a bath of the molten coating material. The surfaces of the strip are wetted with the coating material. After the coated strip leaves the hot dip treatment bath, excess molten coating material is blown off the surface of the strip. The molten coating material cools down and solidifies in the process. While still hot, the coated strip is then either cooled to room temperature or subjected to another treatment. For example, hot dip galvanized strip is subjected to an aging treatment. To do so, the strip is annealed for approximately three minutes at a temperature in the range of about 350° C. to improve its deep drawability (*Stahl und Eisen* [Steel and Iron], volume 102 (1982) no. 24, page 1236).

To improve the surface quality of an enamel or paint layer applied to a galvanized or aluminized thin sheet, it has already been proposed (European Patent No. 710,732 A1) that the coated strip be heated to a temperature above 300° C. up to a temperature below the alloying temperature for less than five minutes. This should prevent micropores from forming in the enamel or paint layer.

The ZnAl melt used according to this invention is a ZnAl alloy containing 3.5–15% Al as the main ingredient in addition to zinc plus traces of rare earths. In addition, traces of magnesium, manganese, copper or silicon may also be present.

The composition of the ZnAl melt yields a solidification behavior leading to "dented" grain boundaries ("grain boundary dents") in the coating surface. This grain boundary formation has a negative effect on the surface appearance. Thus, use of this material in applications where high demands are made of surface quality is limited. Such applications include household appliances and automotive body parts which are provided with a high-quality enamel coating after being shaped and joined.

The object of the present invention is to improve upon the surface quality of the ZnAl coating so that a high-quality surface is obtained after cold working in combination with enameling or other coating methods (chromatizing, phosphatizing, protective enamel coating).

This invention will attempt to create an expedient here and provides for the thin sheet to be heated to a temperature 20 to 100° C. above the melting point of the coating material for two to ten seconds after solidification of the coating applied to its surfaces in the hot dip galvanizing bath and then to be cooled to room temperature.

A significant improvement in surface appearance due to a reduction in grain boundary depth, which is very marked in ZnAl coatings without the use of the heat aftertreatment according to this invention, is found on the finished thin sheet with the heat-treated coating according to this invention. The bloom structure which would otherwise appear is macroscopically blurred and cannot be detected even after enameling or painting.

This macroscopically detectable change is associated with a microscopic change in the structure of the ZnAl coating.

In the starting condition, the typical Zn +5% Al coating consists of the γ-mixed crystal and a eutectic of η- plus β-phases.

After the annealing treatment according to this invention, there is a significant change. The original coarse η-mixed crystal areas are now finely distributed and very numerous. The grains present at the ZnAl surface develop anew and with a significantly smaller grain size due to the heat treatment.

According to a preferred embodiment of the method according to this invention, use for thin sheets coated with a coating of a zinc base alloy containing 4.5 to 5.5% Al is therefore proposed.

A preferred heating is performed according to this invention by an electroinductive method. This permits very precise regulation of the temperature and duration of heating.

Another object of this invention is to improve the workability of a thin sheet coated with a zinc base alloy containing aluminum in a hot dip galvanizing process in such a way that development of cracks in the forming operation is prevented. It is known that thin sheets coated by hot dip galvanizing tend to develop cracks. In the past, this problem has not been solved satisfactorily.

The problem described here is solved by the heat treatment according to this invention. Thin sheets coated by hot dip galvanization and subsequently heat-treated in this way develop considerably fewer and smaller cracks after forming.

Heat-treated thin sheets coated by hot dip galvanizing by the method according to the present invention are suitable especially for applications where high demands are made of surface quality. This is the case especially for household appliances and automotive body parts which are provided with a high-quality paint coating, chromatized coating, phosphatized coating, protective paint coating, enameling or similar surface coating after being shaped and joined.

EXAMPLE

A strip of cold-rolled thin sheet of a vacuum decarbonized (ULC) steel with the dimensions 0.8×1000 mm is passed through a hot dip galvanizing system at the rate of 80 to 100 m/min after being welded to the forward ring at the unwinder at the inlet end and fed into the galvanization installation. The strip is first subjected to a cleaning operation. This is done either in a burn-off furnace with direct heating of the strip surface and a non-oxidizing operation (the strip temperature is about 650° C. at the end of this treatment), or as an alternative, a chemical pretreatment of the strip, e.g., an alkaline cleaning, may be performed.

Then the strip is passed through a furnace area where it is recrystallized at temperatures of approximately 750° C. to improve the cold workability. At the same time, iron oxides present on the surface of the strip are reduced in this furnace area, which is also known as a reducing furnace because the furnace atmosphere contains approximately 65% hydrogen, with the remainder being nitrogen. This prepares for good wetting by the metal melt. Before dipping the strip in the metal melt, the strip temperature is lowered to the range of 500 to 580%.

The strip is guided into the hot dip coating bath through a so-called blowpipe in the absence of air. The blowpipe is provided with heating elements on the inside to heat the strip. Therefore, temperatures of approximately 800° C. are achieved in the blowpipe.

The temperature of the zinc melt containing approximately 5 wt % Al amounts to an average of 430° C. To establish a coating weight of 140 g/m$^2$, for example, and to strip off excess molten metal, a nozzle pressure of approximately 0.3 bar is set. Air or nitrogen may be used as the blow-off medium. In blow-off, the coating material which has previously been molten solidifies.

While still hot, the hot dip coated strip is subjected to the heat treatment according to this invention in a continuous operation. To do so, it is heated briefly to temperatures in the range of 20° C. to 100° C. above the melting point of the coating material for a period of two to ten seconds. The heating time is regulated so that the coating material on the thin sheet may only partially be melted again. The heating may take place under atmospheric conditions. In conclusion, the conventional dressing treatment is performed either wet or dry with a dressing degree of 0.3 to 1.5%.

BRIEF DESCRIPTION OF THE DRAWINGS

FIG. 1 shows cracking in the bend shoulder of a deep-drawn bowl of material which has not been subjected to the reheating treatment according to this invention in the form of a large, deep crack indicated by an arrow. However, the micrograph in FIG. 2 of a deep-drawn bowl specimen of material subjected to reheating according to this invention after deep-drawing shows only insignificant small cracks.

Figure 1:
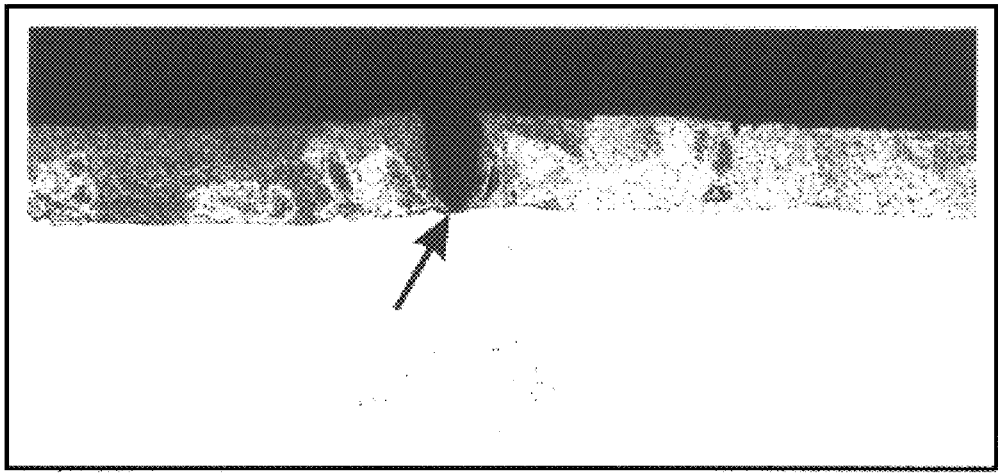
Fig. 1 (Prior Art)
FIGS. 1 and 2 show micrographs on the order of 500:1.
Figure 2:
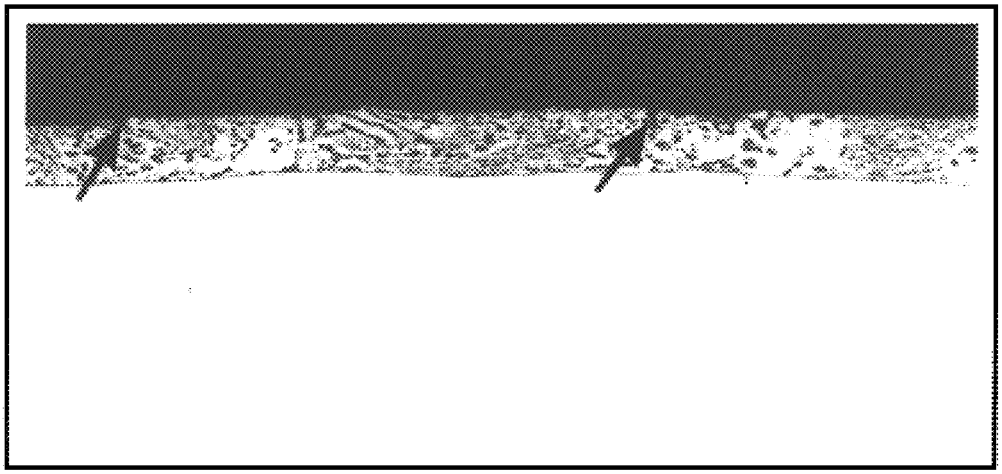

What is claimed is:

1. A method of heat treating a thin sheet having a coating applied by hot dip galvanization, said coating being a zinc based alloy comprising 3.5% to 15% by weight of aluminum, said method comprising the steps of:

heating said thin sheet for 2 to 10 seconds to a temperature which is 20 to 100° C. above the melting point of said coating immediately after solidification of said coating applied during said hot dip galvanization, and cooling said thin sheet to room temperature.

2. A method according to claim 1, wherein said thin sheet is heated by an electroinductive method.

3. A method according to claim 1, comprising heating a thin sheet coated with an alloy comprising 4.5% to 5.5% by weight of aluminum and the remainder zinc.

4. A method according to claim 1, wherein said zinc based alloy comprises 5% by weight of aluminum and has a melting point of 430° C.

* * * * *